US005384017A

United States Patent [19]

Lumbroso

[11] Patent Number: 5,384,017

[45] Date of Patent: Jan. 24, 1995

[54] METHOD OF PRODUCING METAL HYDROXIDES

[75] Inventor: Roger Lumbroso, Paris, France

[73] Assignee: Sorapec S.A., Fontenay-Sous-Bois, France

[21] Appl. No.: 26,745

[22] Filed: Mar. 5, 1993

[30] Foreign Application Priority Data

Mar. 5, 1992 [FR] France ..... 92 02873

[51] Int. Cl.[6] ..... C25B 1/00

[52] U.S. Cl. ..... 204/96; 204/1.5

[58] Field of Search ..... 204/96, 98, 182.4, 1.5; 205/50

[56] References Cited

U.S. PATENT DOCUMENTS

| | | | |
|---|---|---|---|
| 2,832,728 | 4/1958 | Kunin | 204/1.5 |
| 3,856,641 | 12/1974 | Rothman et al. | 204/96 |
| 4,067,788 | 1/1978 | Solomon | 204/96 |
| 4,265,718 | 5/1981 | Limare et al. | 204/96 |
| 5,118,399 | 6/1992 | Vaughan | 204/182.4 |
| 5,135,622 | 8/1992 | Abys et al. | 204/96 |
| 5,198,085 | 3/1993 | Vaughan | 204/182.4 |

FOREIGN PATENT DOCUMENTS 0014111 8/1980 European Pat. Off. .

OTHER PUBLICATIONS

Derwent Abstract, Section ch, Week 8847, Class JO3, AN 88-334249 & JP-A-63-247385.
French Search Report.

*Primary Examiner*—John Niebling
*Assistant Examiner*—Brendan Mee
*Attorney, Agent, or Firm*—Sandler, Greenblum & Bernstein

[57] ABSTRACT

Metal hydroxides are produced in an easy-to-separate powder form from metal in solution, by passing an electric current through the solution to produce the formation of a preceipitated hydroxide against a solid ion-exchange membrane, which membrane separates the anode compartment from the cathode compartment. When the solution is acidic, the membrane is an anion exchange membrane. When the solution is basic, the membrane is a cation exchange membrane.

14 Claims, 1 Drawing Sheet

METHOD OF PRODUCING METAL HYDROXIDES

BACKGROUND OF THE INVENTION

1. Field of the Invention

The present invention relates to a method of producing metal hydroxides in an easy-to-separate powder form, as well as to various applications of this method.

2. Discussion of Background Information

Metal hydroxides of the general formula Me $(OH)_n$ are usually prepared by the action of an alkaline solution on soluble metal salts, to precipitate hydroxides which have a finely divided and often a gelatinous appearence.

The gelatinous appearance obtained does not facilitate washing or the hydroxide and separating it by filtration from the starting solution and from the washing waters. It is therefore difficult to obtain the hydroxide in a powder form with an acceptable purity.

In some other cases, in particular when the hydroxides are soluble in an alkali medium, for example the hydroxides of amphoteric metals, they may in theory be obtained as precipitates by neutralizing a strong base with an acid. In many practical applications, the metals which are dissolved in strong base media are not recovered, but the solutions containing them are purely and simply discharged, with the consequent risks of pollution and toxicity.

SUMMARY OF THE INVENTION

The present invention aims to remedy these drawbacks and to produce metal hydroxides both from acid solutions and from alkaline solutions, in a finely divided and easy-to-wash form and, consequently, with a high degree of purity.

This method is characterized in that an electric current is passed through the solution in which the metal is dissolved to produce the formation of a precipitated hydroxide against a solid ion-exchange membrane, which membrane separates the anode compartment from the cathode compartment.

The expression "against a solid ion-exchange membrane" as used above means that the precipitation takes place on the membrane, or in the immediate proximity thereof, in a zone of the order of 1 mm thick from the membrane.

According to a first embodiment, the solution is an acid solution and the membrane is an anionic membrane, for example a membrane comprising quaternary ammonium groups. This embodiment enables the precipitation and the separation of the metal hydroxide from an acid solution.

According to a second embodiment, the solution is a basic solution and the membrane is a cationic membrane, for example a membrane comprising $SO_3H$-groups.

In either case, the membrane is for example an insoluble polymer incorporating an ion-exchange resin, or an insoluble polymer, for example polytetrafluoroethylene, which has been irradiated in a manner to graft polystyrene carriers of charged groups, as those indicated above.

BRIEF DESCRIPTION OF THE DRAWINGS

The invention will be better understood with reference to the accompanying drawings, given by way of non limiting example. In the drawings.

DETAILED DESCRIPTION OF THE PREFERRED EMBODIMENTS

Figure 1:
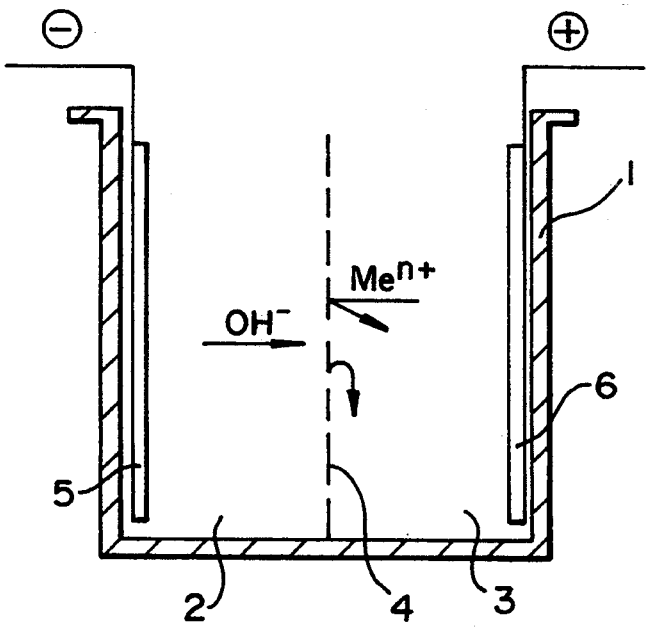
FIG. 1 corresponds to the embodiment where the metal hydroxide is precipitated from an acid solution, and FIG. 2 corresponds to the embodiment wherein the metal hydroxide is precipitated from an alkali solution.

FIG. 1 shows a vat 1 in which an electric current is to be passed, and which is divided into two parts, a cathode compartment 2 and an anode compartment 3, by an anionic membrane 4. In this vat, a cathode 5 is placed in the cathode compartment 2 and an anode 6 is placed in the anode compartment 3.

The cathode compartment 2 is filled with a catholyte, for example a basic solution of caustic soda or caustic potash, and it is fitted with a cathode 5 made of a metal stable in alkali media, for example nickel.

The anode compartment 3 is filled with anolyte, namely a solution of the metal Me whose hydroxide is to be precipitated. The anode is for example made of the same metal, employing the soluble anode technique.

An electric current is caused to flow, advantageously at a potential difference comprised between 5 and 20 V, at a current density preferably comprised between 5 and 20 $A/dm^2$, which produces the following movements.

The metal ions $Me^{n+}$ in the anolyte move towards the cathode, but they are prevented from passing into the catholyte by the anion-exchange membrane; the $OH^-$ ions of the catholyte move towards the anode, pass through the anion-exchange membrane and come into contact with the ions $Me^{n+}$.

The formation of the hydroxide $Me(OH)_n$ thus takes place on the anionic face of the membrane, because the anionic face is highly basic, which is permanently maintained due to the constant regeneration of the membrane by the continuous supply of $OH^-$ ions.

The hydroxide formed is detached from the membrane and sinks in the anolyte. It has a powdered and dry appearance enabling it to be filtered and washed without any difficulty.

For the formation of the hydroxide, it is important that the anolyte be maintained at a pH comprised between 0.5 and a pH less than that which would cause hydrolysis of the anolyte solution, which would lead to an unwanted precipitation of the hydroxide in a gelatinous form. This pH is for example of the order of 4.5 when the anolyte is a $ZnSO_4$ solution, in which case the precipitate obtained is obviously $Zn(OH)_2$. The concentration of metal Me in the anolyte is maintained constant by dissolution of the anode.

In a variation, instead of operating in the soluble anode mode, the concentration of the treated solution is reconstituted by the addition and dissolution of a salt of the metal whose hydroxide is to be produced, for example a carbonate. A non-soluble anode, for example of lead or ruthenised titanium is used.

It is also possible to produce hydroxides of metals such as chromium, nickel, cadmium, cobalt, zinc or uranium, or double or triple hydroxides such as nickel-cadmium hydroxide, or nickel-cadmium-cobalt hydroxide.

The applications of this method concern notably the treatment of uranium ore to recover the metal through its hydroxide, the starting acid solution containing the uranium salt being an acid feed solution of an uranium ore.

Figure 2:
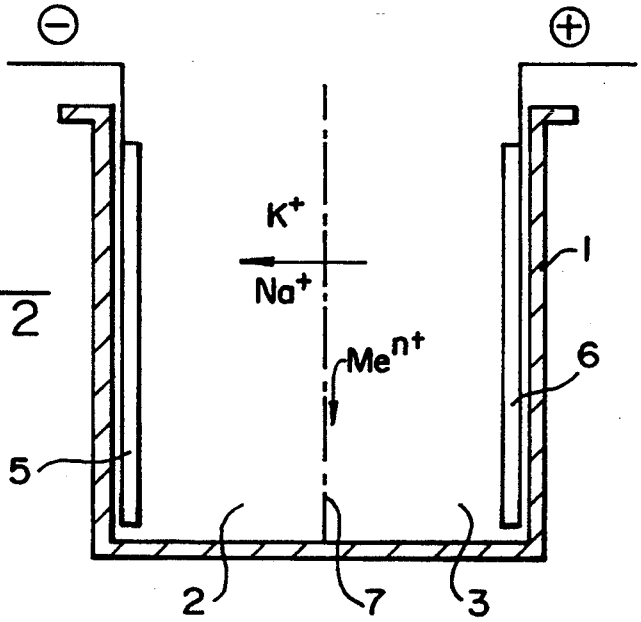

FIG. 2 shows a similar installation, comprising a vat 1, a cathode compartment 2 with a cathode 5 and an anode compartment 3 with an anode 6. In this instance, the cathode compartment 2 and the anode compartment 3 are separated by a cation-exchange membrane 7.

The anode compartment is filled with the solution to be treated, or anolyte, from which the hydroxide is to be precipitated and which, it should be recalled, is a solution of a metal in an alkaline medium. Advantageously a highly concentrated solution of caustic soda or caustic potash is used, for example 8N caustic soda or caustic potash. The cathode compartment is filled with the catholyte, for example a 0.5N solution of caustic potash and the anode and cathode compartments are fitted with respective electrodes of dimensionally-stable, insoluble metal, for instance as mentioned above.

The flow of electric current induces the following movements.

The alkaline cations, for example $Na^+$ or $K^+$, move from the anode compartment 3 towards the cathode compartment 2 through the cation-exchange membrane 7. The catholyte becomes enriched with alkali as the flow of current continues, and, consequently, the pH of the anolyte is reduced. When the pH has dropped to a sufficiently low value, the metal hydroxide $Me(OH)_n$ precipitates in an easy-to-filter form. We may thus refer to this as an electro-dialysis phenomenom.

An advantageous application of this embodiment is the regeneration of strong basic solutions obtained during electrochemical forming of metals, for example, of aluminium. In this case, the starting solution containing aluminium in the form of $AlO_2^-$ ions has a concentration of 8N, and its properties deteriorate when the concentration drops to a value of about 2N. At this point, an 8N alkaline solution has to be reformulated in the cathode compartment, and aluminium recovered in the form of hydroxide precipitated in the anode compartment.

Another application is the regeneration, by the recovery of metals dissolved therein, of basic solutions, namely basic solutions of batteries and accumulators, for example aluminium/air batteries.

The invention will now be illustrated by several non-limiting examples.

EXAMPLES 1 to 5

Using the conditions summarized on the following table where percentages (%) are indicated by weight, hydroxides are obtained in a easy-to-filter and purified form, it being understood that these hydroxides due to their powder form may easily undergo later purification cycles.

| Example | Prepared Hydroxide | Anolyte | Catholyte | Current | Product | Efficiency |
|---|---|---|---|---|---|---|
| 1 | Nickel Hydroxide | 22 N nickel sulfate solution Nickel anode | N caustic soda solution Nickel cathode | 10 A/dm2 V 12 to 18 V | Nickel hydroxide with 70% nickel | 65 to 85% |
| 2 | Cadmium Hydroxide | 12 N cadmium sulfate Solution Cadmium anode | N caustic soda solution Nickel cathode | 10 A/dm2 V 15 to 19 V | Cadmium hydroxide with 81.5% cadmium | 70 to 80% |
| 3 | Nickel and Cadmium hydroxide | 12 N nickel sulfate solution 0.3 N cadmium sulfate solution Cd/Ni 5% Nickel anode | N caustic soda solution Lead cathode | 10 A/dm2 V 12 to 18 V | Nickel cadmium hydroxide comprising 67.6% Ni, 3.3% Cd Cd/Ni 5% | |
| 4 | Triple Hydroxide of nickel, cadmium and cobalt | 12 N nickel sulfate solution 0.3 N cadmium sulfate solution Cd/Ni 5% 1.2 N cobalt sulfate Co/Ni 10% Nickel anode | N caustic soda solution Nickel cathode | 10 A/dm2 V 12 to 18 V Co/Ni 10% | Triple hydroxide of nickel, cadmium and cobalt comprising 62.6% Ni 3% Cd 6.2% Co Cd/Ni 5% | 65 to 85% |
| 5 | Aluminium Hydroxide | 2 N caustic potash Potassium aluminate 495 g/l Lead anode | 0.5 N caustic potash Lead cathode | 15 A/dm2 V 6 to 15 V | Aluminium hydroxide comprising 39% aluminium in the dry product of the anolyte 7 N caustic potash in the catholyte | |

I claim:

1. A method for producing metal hydroxides, in an easy-to-separate powder form, from the metal in solution, comprising:

adding an acidic metal solution to a container, the container including an anode compartment, a cathode compartment, and a solid anionic membrane separating the anode compartment and the cathode compartment; and passing an electric current through the metal solution to precipitate a hydroxide in a powder form against the solid ion-exchange membrane, the metal hydroxide produced comprising double hydroxides of nickel and cadmium or triple hydroxides of nickel, cadmium and cobalt.

2. A method for producing metal hydroxides, in an easy-to-separate powder form, from the metal in solution, comprising:

adding a metal solution comprising an acid solution of a uranium ore to a container, the container including an anode compartment, a cathode compartment, and a solid anionic membrane separating the anode compartment and the cathode compartment; and passing an electric current through the metal solution to precipitate a hydroxide in a powder form against the solid ion-exchange membrane, the metal hydroxide produced comprising uranium hydroxide.

3. A method for producing metal hydroxides in an easy-to-separate powder form, from the metal in solution, comprising:

adding a basic metal solution comprising a basic electrolyte of an aluminum/air battery to a container, the container including an anode compartment, a cathode compartment, and a solid cationic membrane separating the anode compartment and the cathode compartment;

passing an electric current through the metal solution to precipitate a hydroxide in a powder form against the solid ion-exchange membrane; and removing the precipitated hydroxide.

4. The method according to claim 3, wherein the basic solution is added to the anode compartment.

5. The method according to claim 4, wherein the anode compartment comprises a solution consisting essentially of the basic solution.

6. A method for producing metal hydroxides in an easy-to-separate powder form, from the metal in solution, comprising:

adding an acidic metal solution having a pH between 0.5 and a pH less than that which causes hydrolysis of the acid solution to a container, the container including an anode compartment, a cathode compartment, and a solid anionic membrane separating the anode compartment and the cathode compartment; and passing an electric current through the metal solution to precipitate a hydroxide in a powder form against the solid ion-exchange membrane.

7. The method according to claim 6, wherein the metal hydroxide produced comprises a metal hydroxide selected from the group consisting of chromium hydroxide, nickel hydroxide, cadmium hydroxide, cobalt hydroxide, zinc hydroxide and uranium hydroxide.

8. The method according to claim 6, wherein the metal hydroxide produced comprises double hydroxides of nickel and cadmium or triple hydroxides of nickel, cadmium and cobalt.

9. The method according to claim 6, wherein the metal hydroxide produced comprises uranium hydroxide, and the acid solution comprises an acid solution of a uranium ore.

10. The method according to claim 6, wherein the anode compartment includes an anode comprising the same metal included in the metal solution.

11. The method according to claim 6, wherein the anode compartment includes an anode comprising a non-soluble anode, and the method further comprises reconstituting the metal solution by addition of a salt of the metal.

12. The method according to claim 6, wherein the electric current has a potential difference between 5 and 20 V, and a current density between 5 and 20 $A/dm^2$.

13. The method according to claim 6, wherein the acid solution is added to the anode compartment; and a basic solution is added to the cathode compartment.

14. The method according to claim 13, wherein the anode compartment comprises a solution consisting essentially of the acid solution.

* * * * *